US006684767B1

(12) United States Patent
Watanabe et al.

(10) Patent No.: US 6,684,767 B1
(45) Date of Patent: Feb. 3, 2004

(54) SHEET CARRIER APPARATUS

(75) Inventors: Hitoshi Watanabe, Ibaraki-ken (JP); Tetsuya Hashimoto, Ibaraki-ken (JP); Yoshikazu Hara, Ibaraki-ken (JP)

(73) Assignee: Rison Kagaku Corporation, Tokyo (JP)

( * ) Notice: Subject to any disclaimer, the term of this patent is extended or adjusted under 35 U.S.C. 154(b) by 671 days.

(21) Appl. No.: 09/106,281

(22) Filed: Jun. 29, 1998

(30) Foreign Application Priority Data

Jul. 2, 1997 (JP) ..... 9-193265

(51) Int. Cl.[7] ..... B41C 1/14
(52) U.S. Cl. ..... 101/128.4
(58) Field of Search ..... 101/114, 128.4, 101/129, 477, 116

(56) References Cited

U.S. PATENT DOCUMENTS 4,269,594 A 5/1981 Umans et al.
5,160,944 A * 11/1992 Fukumoto et al. ..... 101/408
5,170,215 A 12/1992 Pfeuffer

OTHER PUBLICATIONS

Patent Abstracts of Japan, vol. 096, No. 008, Aug. 30, 199 & JP 08–090,747.

Patent Abstracts of Japan, vol. 016, No. 510 (M–1326), Oct. 21, 1992 & JP04–189543.

* cited by examiner

*Primary Examiner*—Ren Yan
(74) *Attorney, Agent, or Firm*—Kanesaka & Takeuchi

(57) ABSTRACT

A sheet carrier apparatus for conveying a sheet includes a roller having a cylindrical circumferential surface that is made of an elastic material. The apparatus also includes a temperature sensor for detecting a temperature of the roller, and processing device for setting a rotational speed of the roller based on a detection signal from the temperature sensor.

1 Claim, 11 Drawing Sheets

FIG. 11

| ADRESS (HEXADECIMAL) | ROM | A/D VALUE |
|---|---|---|
| 1000H | TIMER VALUE (2byte) | 0 |
| 1002H | TIMER VALUE (2byte) | 1 |
| 1004H | TIMER VALUE (2byte) | 2 |
| ∫ | | ∫ |
| 11FAH | TIMER VALUE (2byte) | 253 |
| 11FCH | TIMER VALUE (2byte) | 254 |
| 11FEH | TIMER VALUE (2byte) | 255 |

SHEET CARRIER APPARATUS

BACKGROUND OF THE INVENTION

The present invention relates to a sheet carrier apparatus for conveying a sheet at a constant speed by using a roller and, more particularly, to a sheet carrier apparatus in which a stencil sheet is conveyed by driving a platen roller to rotate while being pressed against the platen roller by a thermal head.

In a conventional perforating machine, a stencil sheet is conveyed by driving a platen roller to rotate while being pressed against the platen roller by a thermal head.

The platen roller is required to contact the stencil sheet closely with heating elements of the thermal head; thus, the platen roller is made of an elastic material such as rubber, thereby ensuring an enough nip area where the stencil sheet is pinched between the thermal head and the platen roller. In this machine, expansion or shrinkage of the stencil sheet in the conveying direction is to be determined by a diameter of the platen roller and a feeding speed by a motor as driving means.

Since the platen roller is made of rubber as explained, changes of temperature or working conditions of the platen roller vary a diameter of the platen roller.

A change in the diameter of the roller leads to a change in a conveying speed of the roller although a rotating speed of the roller remains unchanged. Thus, expansion/shrinkage ratio of a perforated sheet changes, thereby deteriorating a dimensional accuracy of an image on a printed sheet.

The present invention is achieved to solve the problem described above and; therefore, an object of the present invention is to provide a sheet carriage apparatus which provides a constant conveying speed without being badly affected by changes in working condition thereof.

SUMMARY OF THE INVENTION

A sheet carrier apparatus as defined in the first aspect of the present invention comprises a roller having a cylindrical circumferential surface made of an elastic material, a temperature sensor for detecting a temperature of the roller, and processing means for setting a rotational speed of the roller based on a detection signal from the temperature sensor.

A sheet carrier apparatus as defined in the second aspect of the present invention comprises a thermal head; a platen roller having a cylindrical circumferential surface made of an elastic material and pressed against the thermal head, the platen roller being rotated to convey the stencil sheet between the platen roller and the thermal head; a temperature sensor for detecting a temperature of the platen roller; and processing means for setting a rotational speed of the platen roller based on a detection signal from the temperature sensor.

In a sheet carrier apparatus as defined in the third aspect of the present invention, the processing means is so constituted that the processing means executes a predetermined computing equation based on the detection signal from the temperature sensor, thereby obtaining a diameter of the roller in the detected temperature, and outputs a control signal for setting the rotational speed of the roller according to the diameter, so that the sheet can be conveyed at a constant speed regardless of a temperature change in the sheet carrier apparatus as defined in the first aspect.

In a sheet carrier apparatus as defined in the fourth aspect of the present invention, the computing equation is as follows:

$$St=Ss\div\{1+\alpha(t-T)\div\phi s\}$$

where, St is a corrected rotational speed [rpm] of the platen roller; Ss is a rotational speed [rpm] of the platen roller in T ° C.; $\phi s$ is a diameter [mm] of the platen roller in T ° C.; $\alpha$ is an expansion coefficient [mm/° C.] of the platen roller; and t is a temperature[° C.] of the platen roller, in the sheet carrier apparatus as defined in the third aspect.

In a sheet carrier apparatus as defined in the fifth aspect of the present invention, an $\alpha$ in a temperature range over a predetermined temperature is smaller than an $\alpha$ in a temperature range less than the predetermined temperature in the sheet carrier apparatus as defined in the fourth aspect.

A sheet carrier apparatus as defined in the sixth aspect of the present invention further comprises a memory which prestores data indicating a rotational speed corresponding to the temperature of the roller, in which apparatus the processing means reads the memory based on the temperature indicated by the detection signal from the temperature sensor so as to obtain the rotational speed corresponding to the temperature, thereby controlling rotation of the roller in the sheet carrier apparatus as defined in the first aspect.

In a sheet carrier apparatus as defined in the seventh aspect of the present invention, the temperature sensor directly detects the temperature of the roller while being in contact with the roller in the sheet carrier apparatus as defined in the first aspect.

In a sheet carrier apparatus as defined in the eight aspect of the present invention, the temperature sensor is disposed at a predetermined distance with the roller and detects a peripheral temperature of the roller in the sheet carrier apparatus as defined in the first aspect.

A temperature sensor detects temperature of a roller conveying a sheet, and the detected temperature is outputted to processing means. The processing means calculates a diameter of the roller based on the detected temperature, thereby determining a rotational speed for a constant circumferential speed of the roller based on the diameter.

The roller, while being controlled to rotate at the determined rotational speed, conveys the sheet at a constant speed regardless of the changes in temperature.

The expression "temperature of the roller" as used herein means not only the temperature of the roller itself but also a peripheral temperature around the roller or a temperature of an atmosphere in which the roller is disposed.

In the present invention, at least a cylindrical circumferential surface of the roller is made of an elastic material; otherwise, the whole roller may be made of the material.

BRIEF DESCRIPTION OF THE DRAWINGS

FIG. 11 is an imaginary view showing storage of a memory;

DETAILED DESCRIPTION OF PREFERRED EMBODIMENTS

Figure 1:
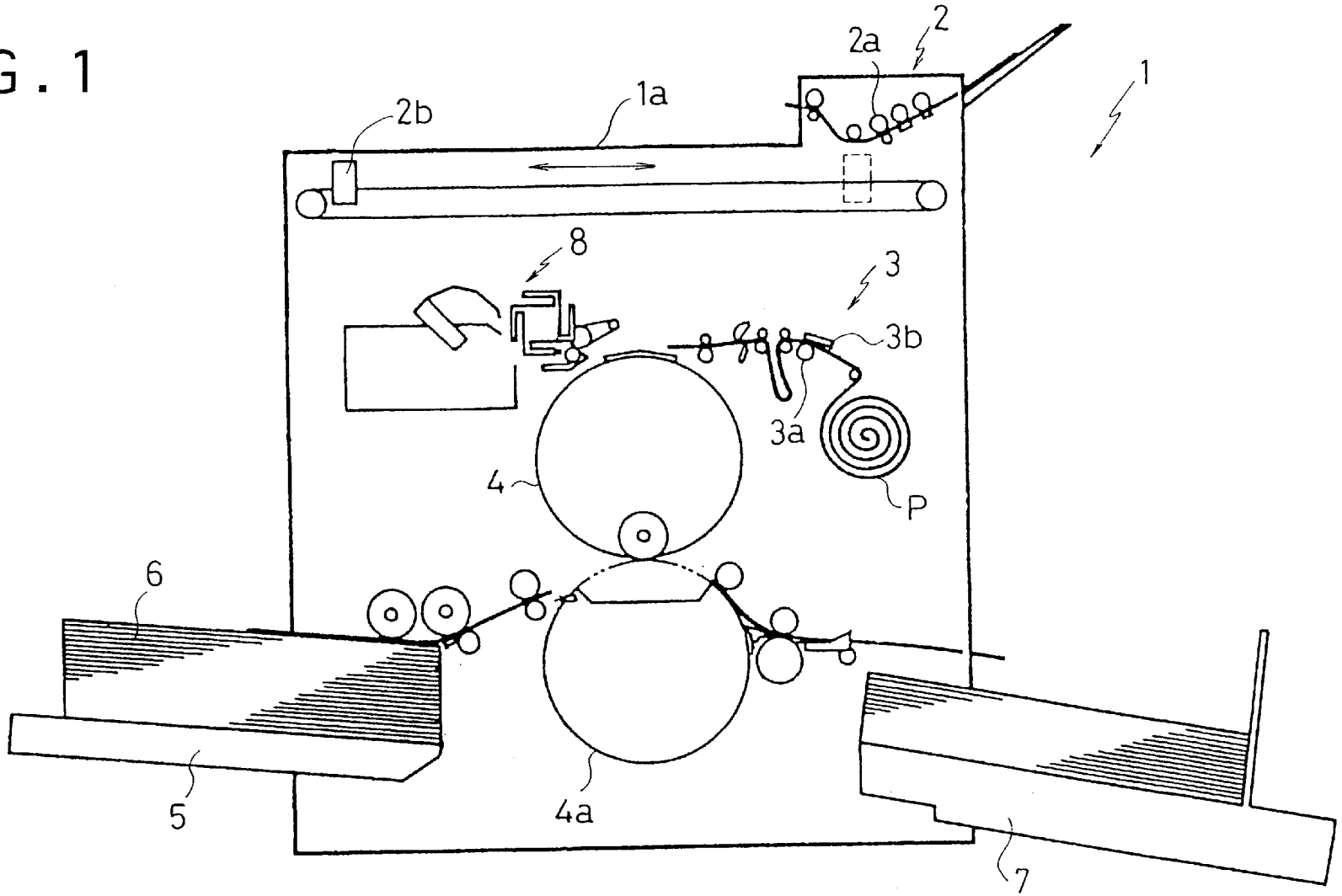
FIG. 1 is a view illustrating a stencil printing machine to which a sheet carrier apparatus of the present invention is adapted.

FIG. 1 is a side view showing a stencil printing machine to which a sheet carrier apparatus in the present invention is adapted.

A reader 2 is disposed to the upper portion of the printing machine 1. An original is read by an image sensor 2*b* such as CCD and so on, while being conveyed by an original conveying section 2*a* comprising plural conveying rollers, and then, an image signal is output from the image sensor to a perforating section 3. In this case the image sensor 2*b* is fixed to a position shown in a broken line in FIG. 1. Otherwise, the original may be read after being placed directly on a scan table 1*a* of the upper portion of the printing machine 1, wherein the image sensor 2*b* scans the original in the arrow direction shown in the drawing.

A perforating section 3 perforates a stencil sheet (master) P by a thermal head 3*b* according to an image signal, while conveying the stencil sheet by a stencil conveying section comprising a platen roller 3*a* and so on. The platen roller 3*a* is made of an elastic material such as rubber and so on; therefore, a nip area where the stencil sheet is pinched between the thermal head and the platen roller is enough large.

The stencil sheet P, while being clamped by one end thereof by a clamping device of a printing drum, is wrapped around the outer circumferential surface of the drum, and then rotates with the drum.

The printing paper (paper) 6 on a paper feed section 5 passes between the drum 4 and a paper drum 4*a* (press roller). Ink inside the drum is transferred to the paper 6, thereby forming an image on the paper. The printed paper is successively discharged onto a discharge section 7.

After printing, the used stencil sheet P is discharged into a stencil discharge section 8.

Hereinafter, a constitution of one embodiment of the present invention will be explained. In the embodiment, the sheet carrier apparatus in the present invention is adapted to the perforating section 3 of said stencil printing machine for conveying the stencil sheet P.

Figure 2:
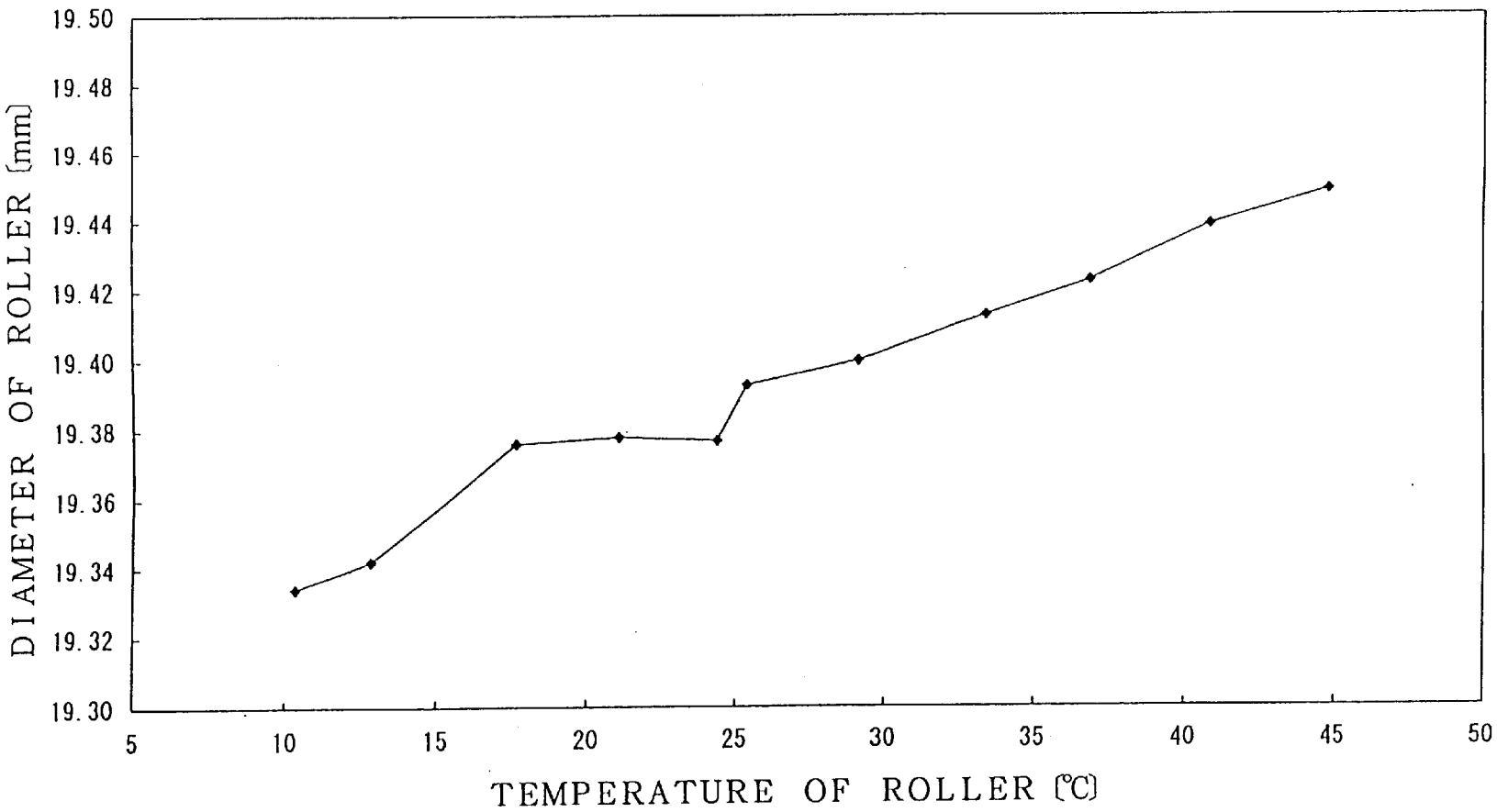
FIG. 2 is a graph showing a temperature change characteristic of a roller.

In the perforating section 3, the platen roller 3*a* is composed of a metal axis and a rubber material wrapped around the axis; thus, the diameter of the roller changes according to a change in temperature or working conditions. FIG. 2 is a graph showing one example of temperature diameter relationship of the platen roller 3*a*. This platen roller 3*a* is of hardness 40#7.

In this way, when a perforating operation is conducted with the diameter of the platen roller as changed, expansion or shrinkage arises in a perforated image, thereby deteriorating a dimensional accuracy of an image on a printed sheet obtained.

Figure 3:
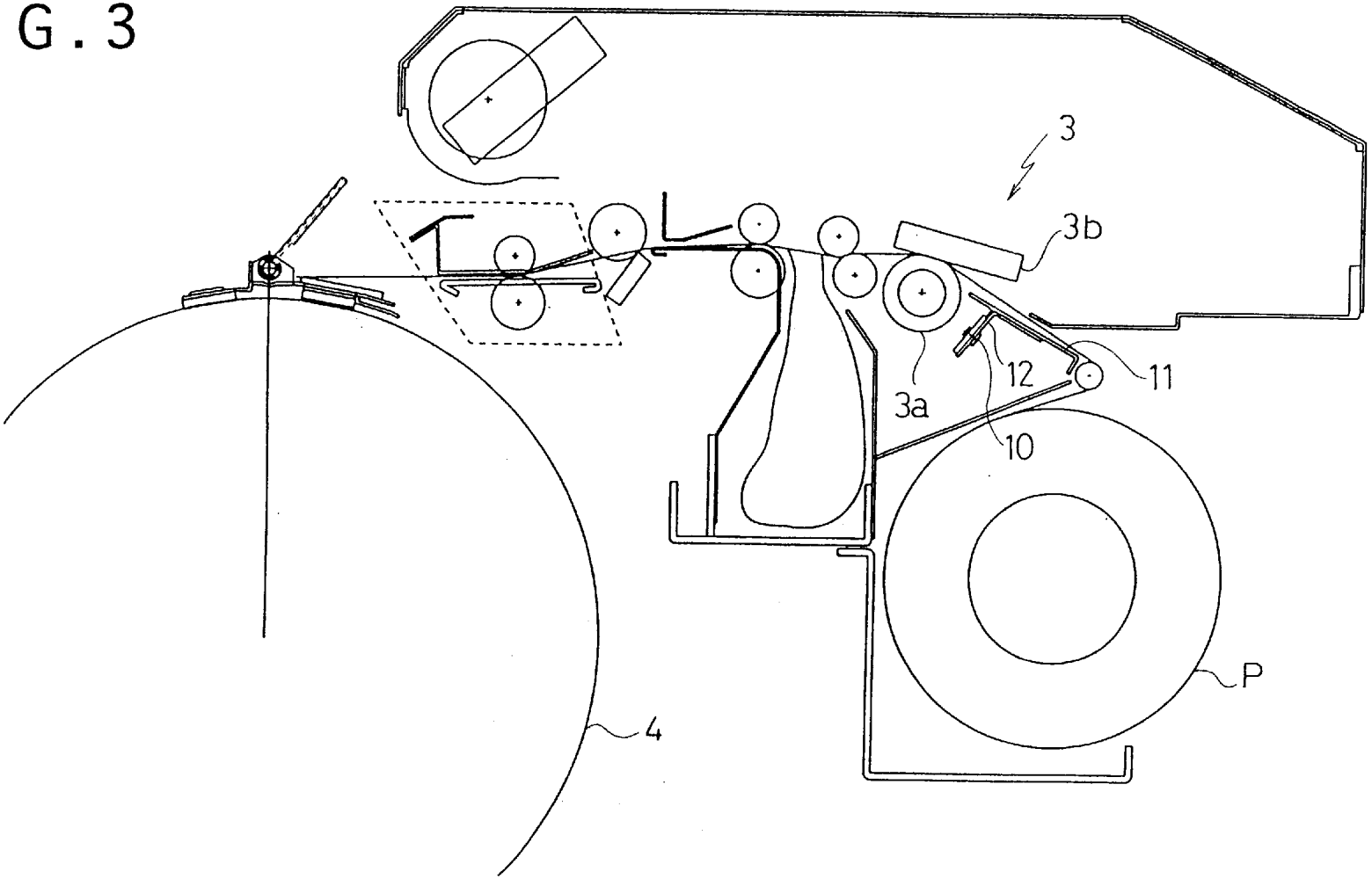
FIG. 3 is a view illustrating a perforating section.

FIG. 3 is an enlarged view of the perforating section 3.

Adjacent to the platen roller 3*a*, a temperature sensor 10 is disposed for detecting a peripheral temperature around the platen roller 3*a*. A detection signal from the sensor is outputted into a processing means 20.

A mounting plate 12 is attached to a guide plate 11. The temperature sensor 10 is attached to the mounting plate 12. The temperature sensor 10 may be so constituted that the sensor is in contact with the circumferential surface of the platen roller 3*a* and directly detects temperature of the platen roller 3*a*.

Figure 4:
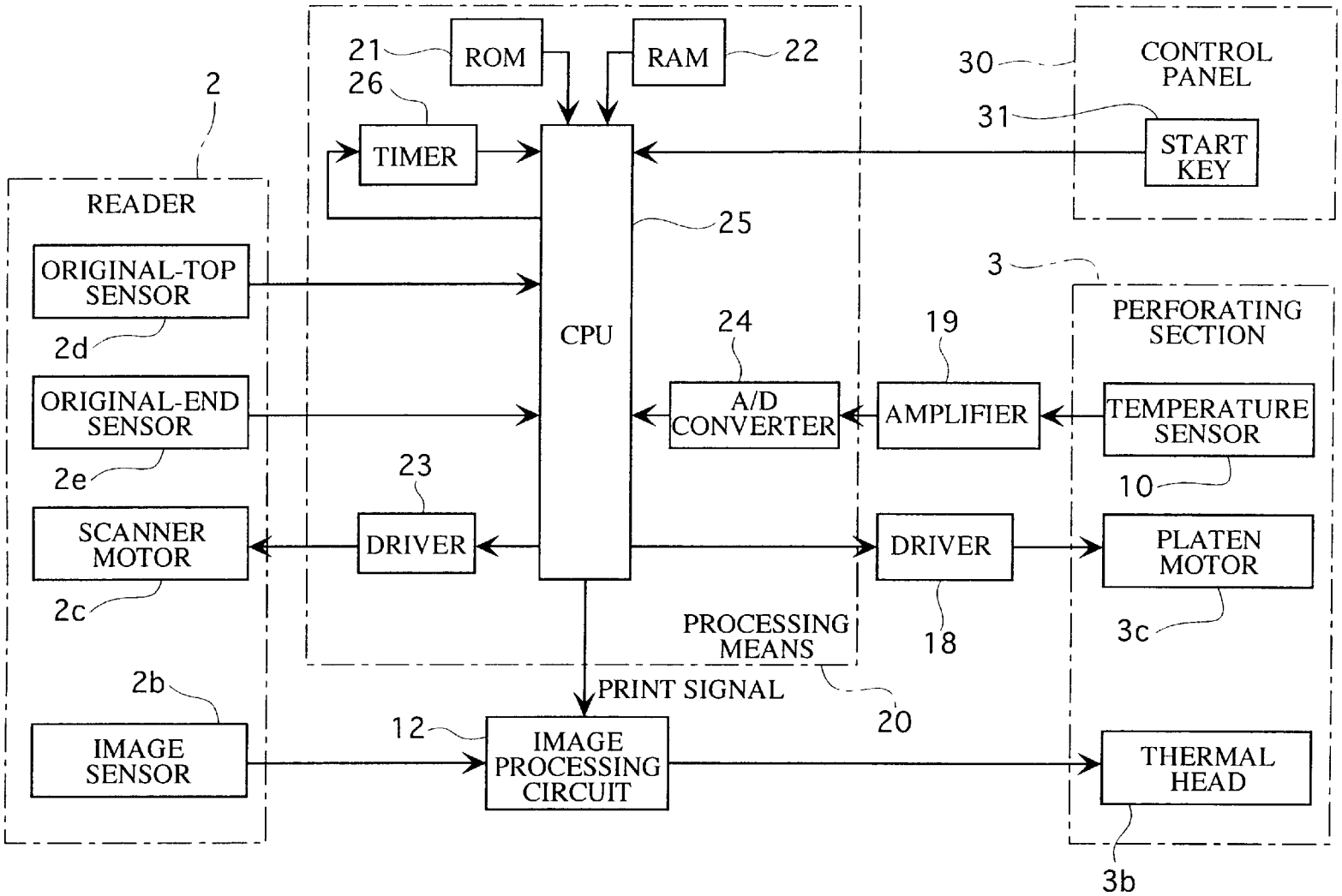
FIG. 4 is a block diagram showing an electrical constitution of one embodiment of the present invention.

FIG. 4 is a block diagram showing an electrical constitution of the present invention.

An image signal, after being read by the image sensor 2*b* in the reader 2, is outputted into an image processing circuit 12 and processed in a predetermined method. And then the processed signal is outputted into the thermal head 3*b* in the perforating section 3.

A scanner motor 2*c* that is controlled by a driver 23 in a processing means 20 drives the image sensor 2*b*. The sensor reads a document placed on the document table la while moving.

An original-top sensor 2*d* detects an initial position where the image sensor 2*c* starts moving. An original-end sensor 2*e* detects an end portion where the sensor stops. Signals outputted from the original-top sensor and the original-end sensor are inputted into a CPU 25 in the processing means 20.

Figure 5:
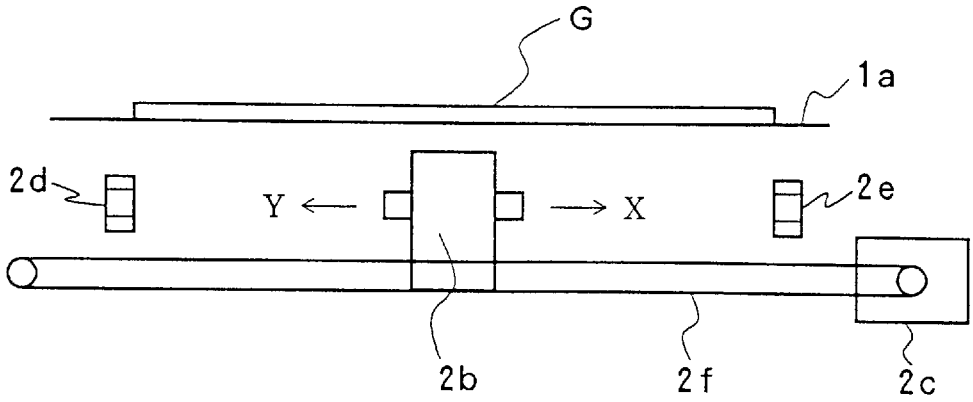
FIG. 5 is a view illustrating a document reading section.

The image sensor 2*b* connected with an endless belt 2*f* reads a document G, while being driven by the scanner motor 2*c* to move along the bottom surface of the document G, as illustrated in FIG. 5.

Further, the platen roller 3*a* in the perforating section 3 is driven to rotate by a platen motor 3*c*. The platen motor 3*c* controls a rotational speed of the platen roller 3*a* via the driver 18 according to a control signal from the processing means 20.

Figure 6:
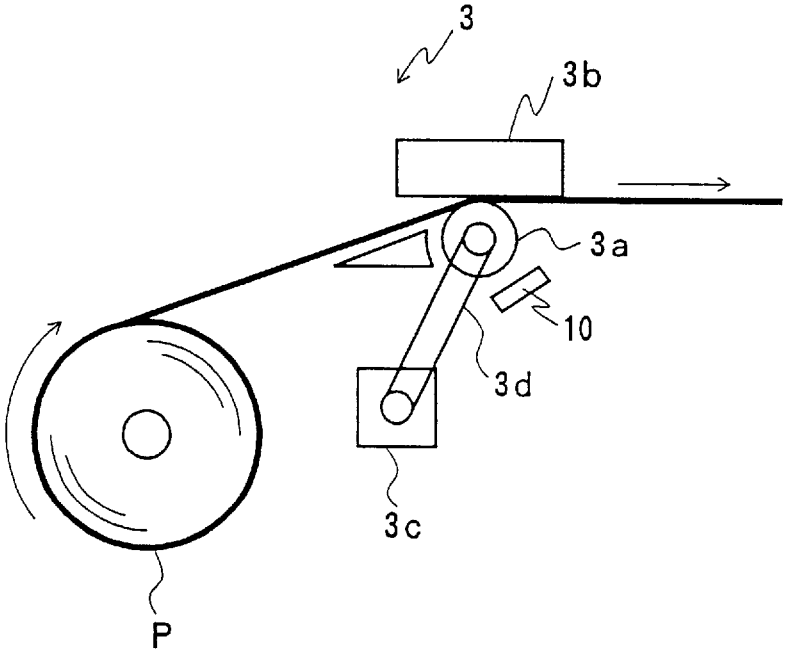
FIG. 6 is a view illustrating a perforating section.

As illustrated in FIG. 6, the platen motor 3*c* may be a stepping motor, which is driven to rotate by pulse input, and is connected to the platen roller with an endless belt 3*d*.

Further, the temperature sensor 10 detects a temperature of the platen roller 3*a*. The detected temperature, after being amplified predetermined-fold (ten-fold, for example) by an amplifier 19, is converted from analog to digital at an A/D converter 24 included in the processing means 20, and then outputted into the CPU 25.

The processing means 20 may be a one-chip computer which comprises the CPU, a ROM 21 as a memory, a RAM 22 as a memory, the A/D converter 24, and a timer 26 for the platen motor. The processing means controls a printing operation of the printing machine according to an execute program stored in the ROM 21, and executes a process of correction for temperature as explained afterward.

Pressing a start key 31 on a control panel 30 of the stencil printing machine 1 initiates the perforating operation and the printing operation. The perforating operation starts as soon as the process of correction for temperature is executed.

The CPU 25 in the processing means 20 calculates a diameter of the platen roller 3*a* according to a temperature of the platen roller 3*a* detected by the temperature sensor 10, thereby outputting a control signal for controlling a rotational speed of the platen roller 3*c* so that a peripheral speed of the platen roller 3*c*, i.e. a conveying speed of the stencil P can be kept at a constant value.

Figure 7:
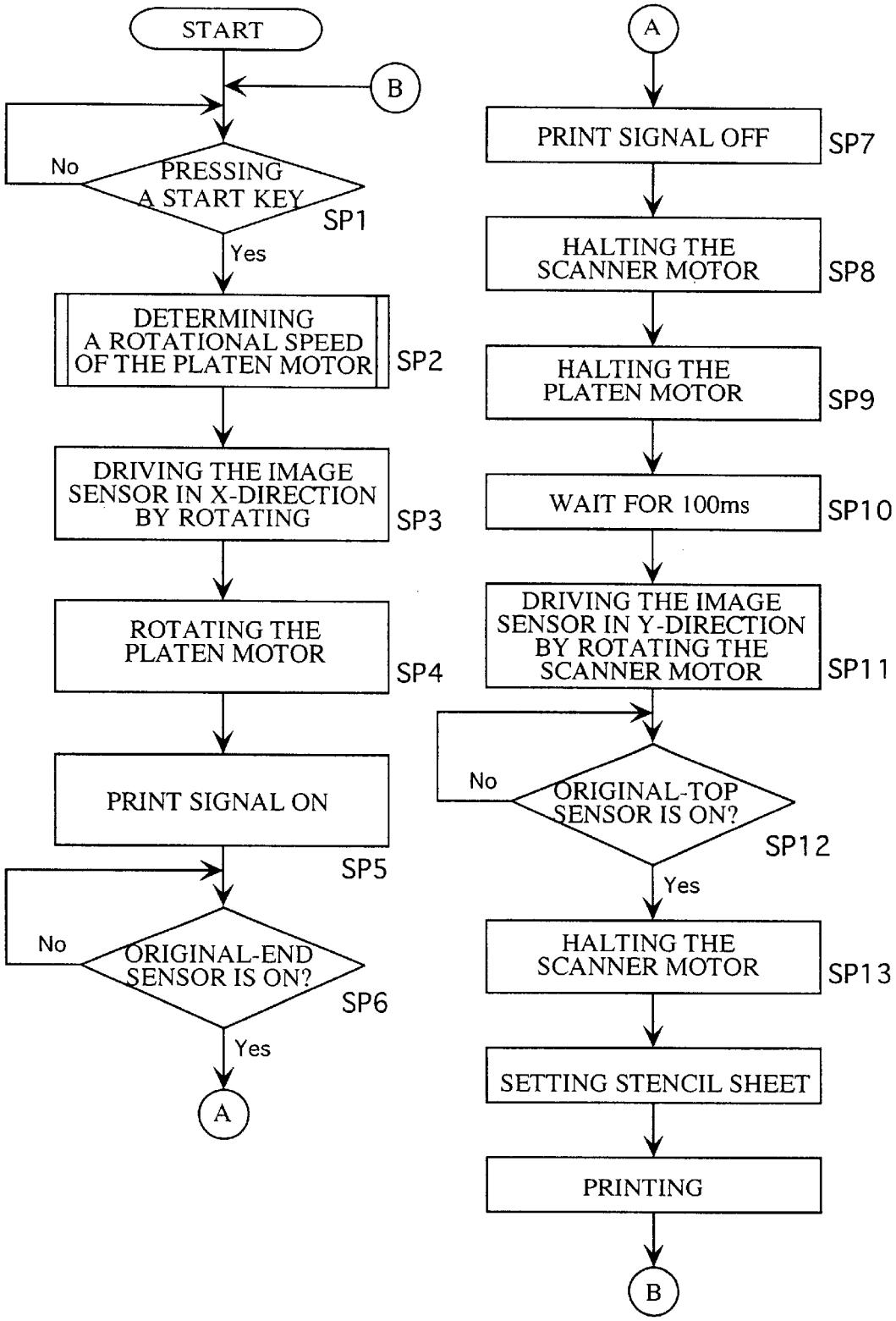
FIG. 7 is a flow chart showing an operation of one embodiment of the present invention.

Next, with reference to a flow chart of FIG. 7, the processing executed by the processing means 20 will be explained.

When the start key 31 is pressed (SP1-YES), a process of determining a rotational speed of the platen roller 3*c* is executed (SP2). Details of the process will be described afterward.

As illustrated in FIG. 5, the scanner motor 2*c* drives the image sensor 2*b* to start from a left position and move in the X direction. While moving, the image scanner reads an original G placed on the scan table 1*a* (SP3).

At the same time, the platen motor 3*c* rotates to drive the stencil sheet P at the rotational speed determined at SP2 according to the input control signal (SP4).

In this way the image sensor 2*b* reads the image on the original G, thereby outputting an image signal. The image signal is processed in the image processing circuit 12. The image signal as processed drives the thermal head 3*b* to conduct a heatsensitive perforation on the stencil sheet P simultaneously with the image processing. A print signal is generated (ON) according to an image forming area of the stencil sheet, and the thermal head 3*b* perforates the stencil sheet P by heat according to the image signal (SP5).

Reading the original G and perforating the stencil sheet P are continued until the image sensor 2*b* reaches the original-end sensor 2*e* after moving in the direction X (SP6-YES). When the image sensor reaches the end of the original G to turn the print signal off (SP7), scanner motor 2*c* is halted (SP8) and also the platen motor 3*c* halted (SP9) simultaneously with the motor 2*c*.

After a predetermined time (100 ms, for example) passes (SP10), the scanner motor 2*c* moves the image sensor toward the initial position (SP 11). At this time the original is not scanned.

When the image sensor 2*b* moves in the direction Y and reaches the original-end sensor 2*d* (SP12-YES), the scanner motor 2*c* is halted, thereby being restored to the initial position (being set in an entry mode for SP1).

Figure 8:
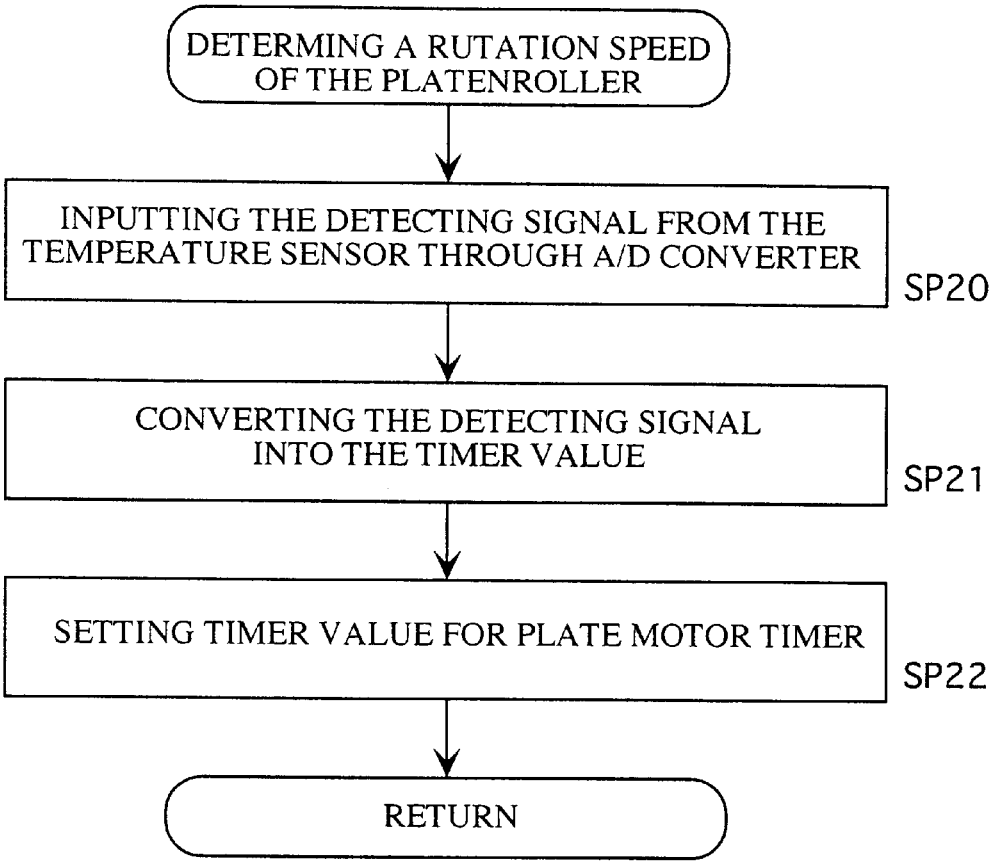
FIG. 8 is a flow chart showing an operation of one embodiment of the present invention.

FIG. 8 is a flowchart showing a process how the rotational speed of the platen roller 3*c* is determined.

Firstly, just after the start key 31 is operated, the detecting signal is inputted to the CPU through the amplifier 19 and the A/D converter (SP20).

According to a temperature indicated by the detecting signal, a predetermined calculation is executed so that the detecting signal is converted into a timer value (SP21). This timer value is set on the timer 26 for the platen motor (SP22).

In the process where the detecting signal is converted into the timer value, the following computing equation (1) is executed so as to obtain a rotational speed St of the platen roller 3*a* (platen motor 3*c*).

$$St = Ss \div \{1 + \alpha(t - 25) \div \phi s\} \quad (1)$$

where, St=corrected rotational speed [rpm] of the platen roller, Ss=rotational speed [rpm] of the platen roller in 25° C., $\phi$s=diameter [mm] of the platen roller in 25° C., $\alpha$=expansion coefficient [mm/° C.] of the platen roller, t=temperature[° C.] of the platen roller.

A numerical example for each of the parameters listed above will be shown hereinafter.

Suppose that t is 30[° C.], Ss is 20[rpm], $\phi$s is 22.96[mm], and $\alpha$ is 0.0034[mm/° C.].

These values except "t" are optional parameters that are obtained by an experiment.

These values are substituted for the parameters in the computing equation (1), so that St is calculated. The St obtained is 19.9852[rpm].

Figure 9:
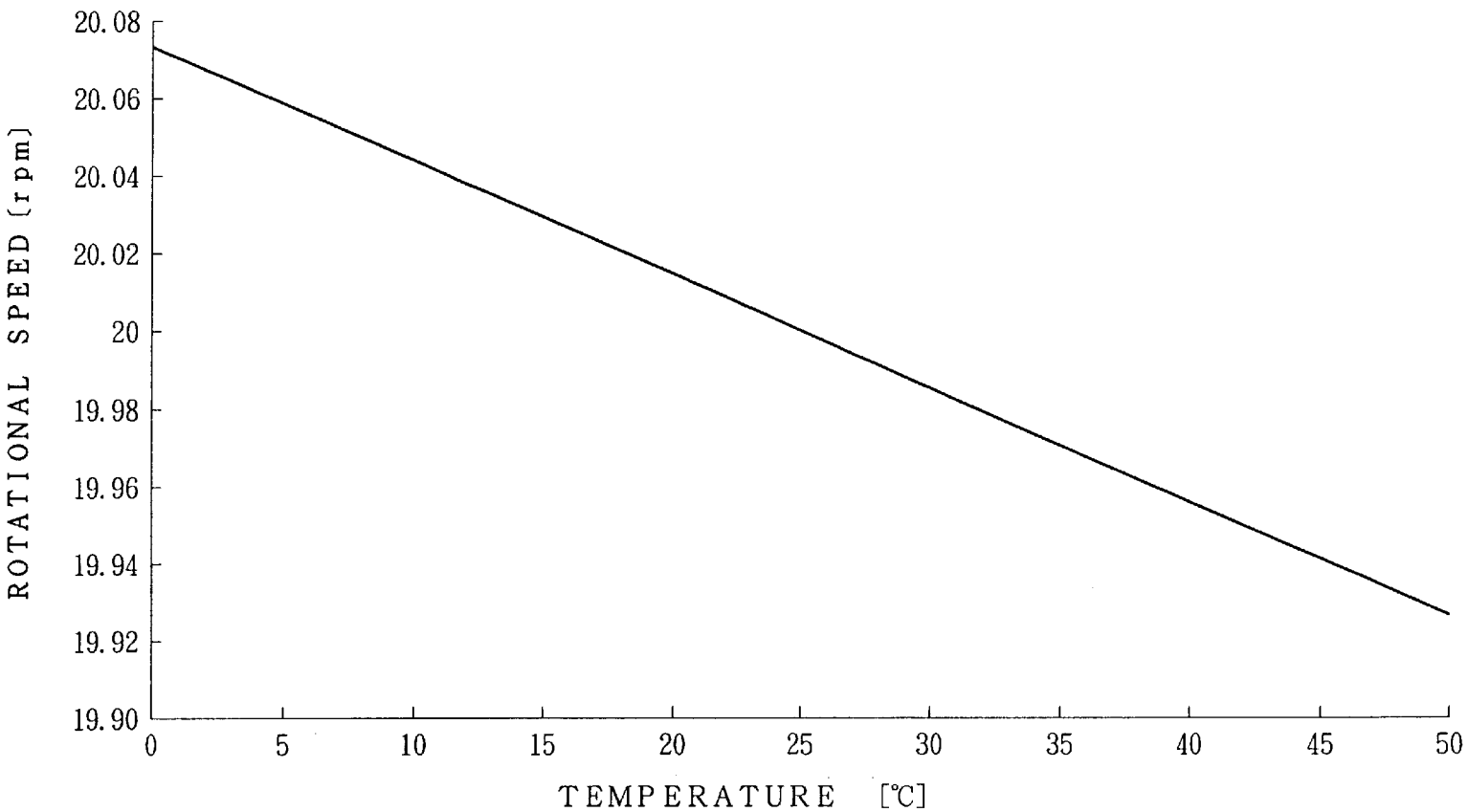
FIG. 9 is a graph showing a characteristic line for correcting a rotational speed of a roller.

FIG. 9 is a graph showing a temperature rotational-speed relation according to the equation (1). As shown in the drawing, the linear characteristic line means that the controlled rotational speed decreases with increasing temperature.

In SP22, the timer value is set in the timer 26 for the platen motor. The timer value changes an interruption cycle of the timer 26. According to the changed interruption cycle, the platen motor 3*c* is driven for a predetermined number of the pulses. Accordingly, the shorter the interruption cycle is, the higher the platen roller 3*a* rotates; conversely, the longer the cycle is, the lower the roller rotates. In this way, although increase in temperature makes the diameter of the platen roller 3*a* larger, the circumferential speed of the platen roller 3*a* can be kept constant by decreasing the rotational speed of the platen roller 3*a* accordingly. Thus, a sheet expansion/shrinkage ratio during perforation can be kept constant regardless of the changes in working atmosphere and condition.

Afterwards, the stencil sheet P is wrapped around the printing drum 4 and then printing starts; however, no deterioration arises in a dimensional accuracy of an image on a printed sheet obtained, since a perforating condition is kept constant.

Figure 10:
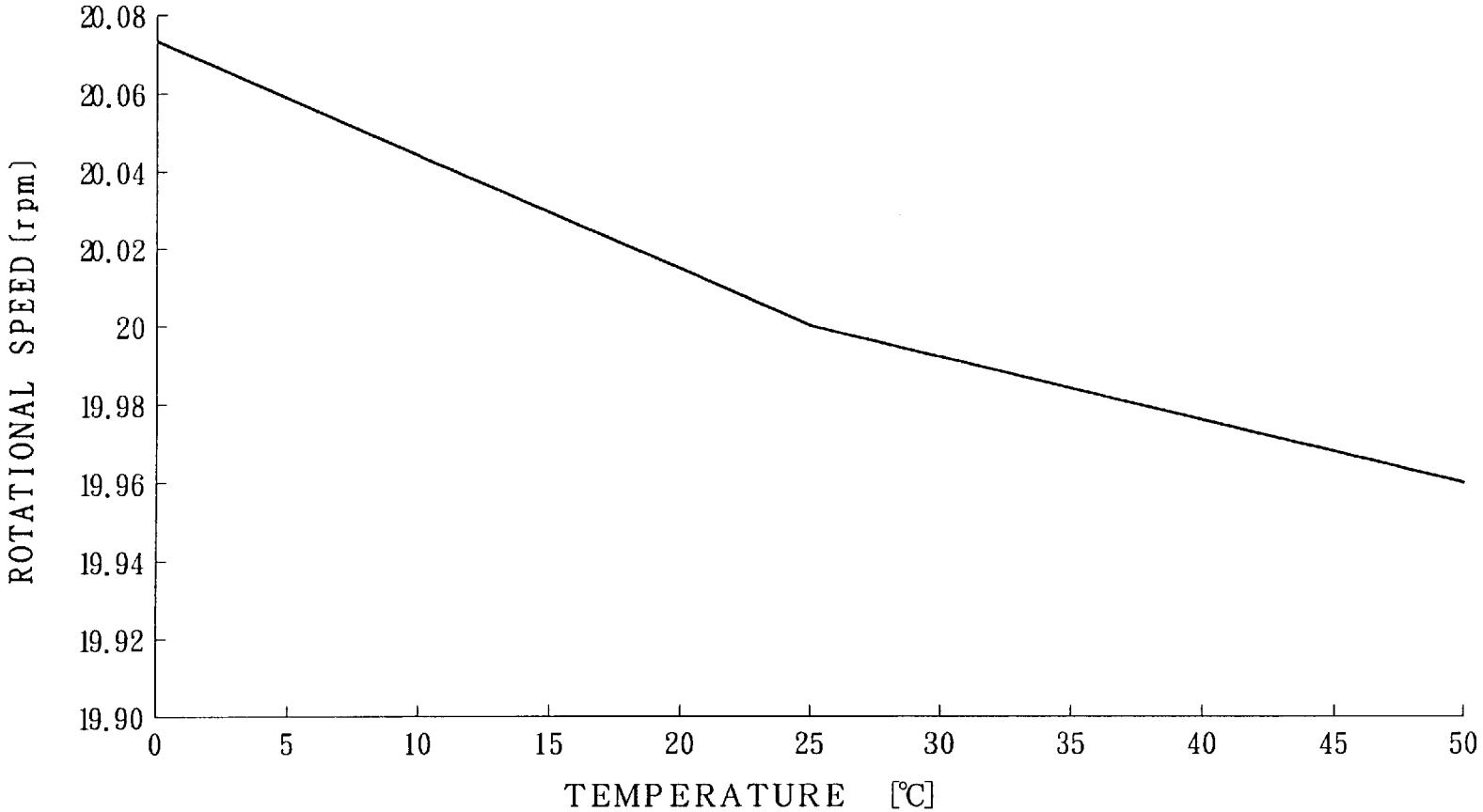
FIG. 10 is a graph showing a characteristic line for correcting a rotational speed of a roller.

When a rotational speed of the platen roller is actually measured to confirm the equation (1), there is a tendency for a conveying speed by the roller to decrease with increasing temperature due to excessive correction. Thus, the $\alpha$ may be decreased by a half value (mm/° C.) in a range over 25° C., so that an effect of the correction in the range can be reduced. In this case, the CPU 25 is so constituted that the CPU switches one $\alpha$-value to the other after judging whether the temperature is over 25° C. according to the detecting signal. A characteristic graph for temperature rotational-speed relation of the platen roller 3*a* in this constitution is shown in FIG. 10.

In the constitution explained above, the equation (1) is executed at every printing operation to determine the rotational speed of the platen roller 3*a*; otherwise, the ROM 21 may prestore timer values for determining the rotational speed of the platen roller 3*a* corresponding to the detected temperature.

FIG. 11 illustrates an imaginary inner constitution of the ROM having prestorage explained above. In each address of the ROM 21, a timer value corresponding to a detected temperature is stored in a table lookup format. When a resolution of the A/D converter is made by 8 bits, temperature can be detected in 256 gradations, and the timer value corresponding to each gradation of the temperature is stored by 2 bytes in each of the addresses.

The CPU 25 reads in an address corresponding to a digital data converted from an analog data at the A/D converter 24, thereby obtaining a timer value.

In the embodiment explained above, a speed control of the platen roller 3*a* of the perforating section 3 has been explained; however, this invention is not restricted to such the platen roller 3*a*. According to the present invention, also in a mechanism that includes a roller with a variable expansion coefficient due to changeable temperature, a conveying speed by the roller can be kept constant in a similar way by changing the speed of the roller.

Figure 12:
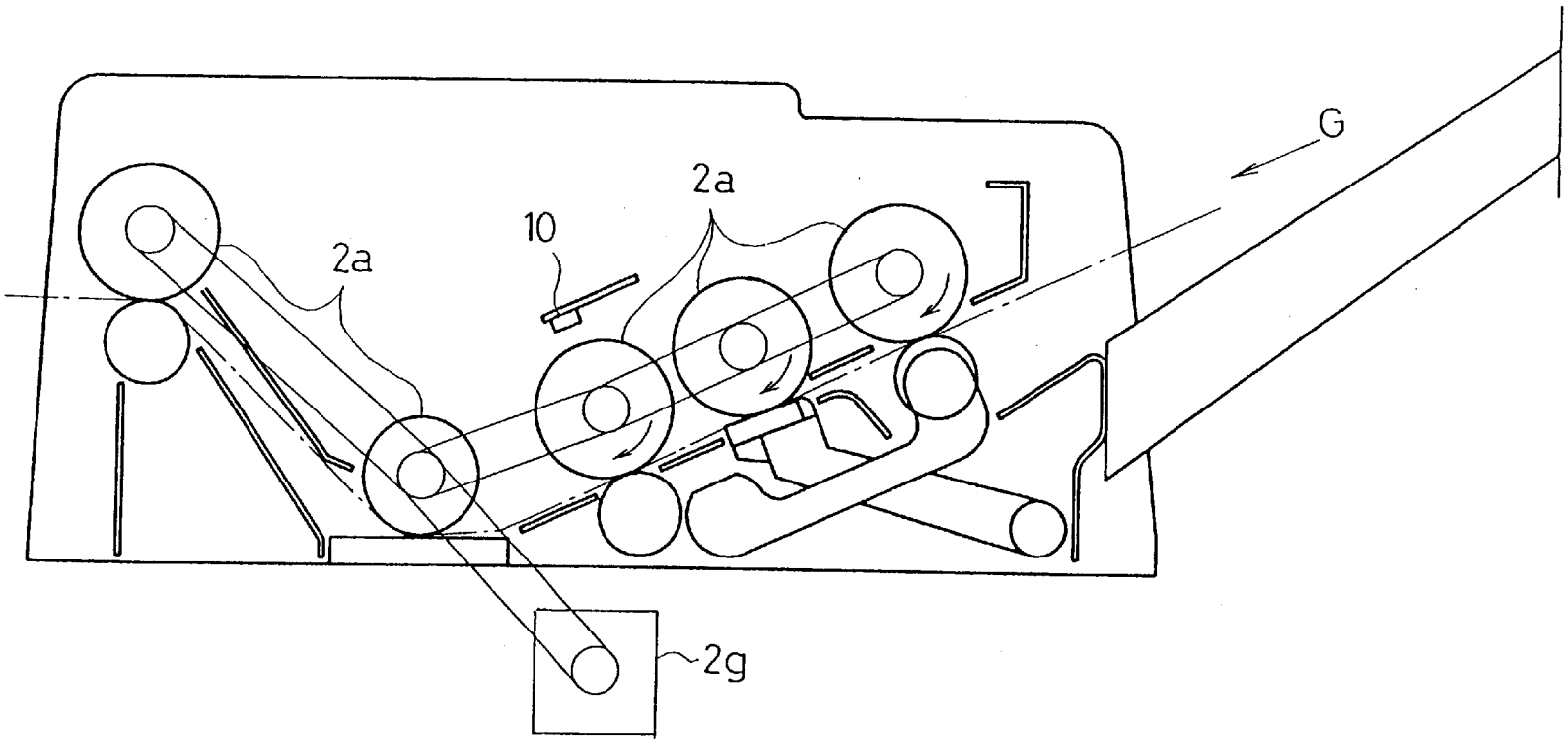
FIG. 12 is a view illustrating a document reader to which a sheet carrier apparatus of the present invention is adapted.

FIG. 12, for example, is a view illustrating a document reader 12 to which the present invention is also applicable. This reader 2 is an automatic document feeder (ADE). The feeder is so constituted that the feeder reads an original G by a fixed image sensor 2*b* while conveying the original by plural conveying rollers 2*a*, thereby outputting an image signal.

The conveying rollers 2*a* are also composed of an elastic material like rubber, so that the enough nip area is ensured. Therefore, the diameter of the conveying roller 2*a* changes according to the changes in temperature. This results in changes in the conveying speed of the original.

Correspondingly, a temperature sensor 10 is disposed adjacent to the conveying roller 2*a*, and a rotational speed of the conveying roller 2*a* (an original conveying motor 2*g*) is variably controlled. The method of controlling the rotational speed may be based on either the computing equation (1) or the table lookup of the ROM.

In this way since the original G is conveyed at a constant speed regardless of the changes in temperature, thus a stable original reading can be achieved.

In the present embodiment, the speed control of the platen motor 3*c* is conducted in such a manner that the timer value is set in the timer 26 for the platen motor, and the CPU outputs the control signal for controlling the platen motor 3*c* according to the interruption by the timer. Otherwise, the driver 18 may energize and drive the platen motor 3*c* directly according to the timer value stored in the timer 26.

In the present embodiment, the stencil printing machine is explained as an example to which the sheet carrier apparatus in the present invention is applicable; however, the present invention is not restricted to the stencil printing machine only. Namely, the present invention is also applicable to an apparatus that includes a roller with a variable expansion coefficient due to changeable temperature, such as a sheet conveying device in other types of a printing machine, a copier, and a facsimile.

Further, real-time temperature of the roller may be detected so that the interruption by the timer can be executed during conveyance as well as before conveyance, thereby achieving a farther higher precision control of the rotational speed of the rollers.

According to the present invention, the rotational speed of the roller is variably controlled according to the changes in temperature of the roller, so that a sheet can be conveyed surely at a constant speed.

In the case where the sheet is a stencil sheet, which is to be wrapped around the drum for printing, a dimensional accuracy of an image on a printed sheet obtained is stably constant, since perforations can be constantly formed in the stencil sheet regardless of the changes in temperature.

Further, in the case of an original as the sheet, an accurate conveying is achieved because of a constant speed in conveying the original. Still further, in the case of an image scanner of moving original exposure type, a high reading-accuracy of an image sensor is ensured to be achieved.

What is claimed is:

1. A sheet carrier apparatus for conveying a sheet, comprising:

a thermal head, a platen roller having a cylindrical circumferential surface made of an elastic material and pressed against the thermal head, said platen roller being rotated to convey said sheet between said platen roller and said thermal head, a temperature sensor for detecting a temperature of said platen roller, processing means electrically connected to the temperature sensor for setting a rotational speed of said platen roller based on a detection signal from said temperature sensor, and a motor connected to the platen roller for rotating the same at a speed set by the processing means so that the sheet is transferred by the platen roller at a predetermined speed regardless of a temperature of the platen roller, wherein said processing means is so constituted that said processing means executes a predetermined computing equation based on said detection signal from said temperature sensor, thereby obtaining a diameter of said roller in the detected temperature, and outputs a control signal for setting said rotational speed of said roller according to said diameter so that said sheet can be conveyed at a constant speed regardless of a temperature change, said computing equation is as follows:

$$St = Ss \div \{1 + \alpha(t - T) \div \phi s\} \qquad \text{computing equation}$$

wherein St is a corrected rotational speed (rpm) of the platen roller; Ss is a rotational speed (rpm) of the platen roller in T ° C.; $\phi$s is a diameter (mm) of the platen roller in T ° C.; $\alpha$ is an expansion coefficient (mm/° C.) of the platen roller; and t is a temperature (° C.) of the platen roller, an $\alpha$ in a temperature range over a predetermined temperature is smaller than an $\alpha$ in a temperature range less than the predetermined temperature.

* * * * *

UNITED STATES PATENT AND TRADEMARK OFFICE

CERTIFICATE OF CORRECTION

PATENT NO. : 6,684,767 B1
DATED : February 3, 2004
INVENTOR(S) : Hitoshi Watanabe et al.

It is certified that error appears in the above-identified patent and that said Letters Patent is hereby corrected as shown below:

Title page,
Item [73], Assignee, change "Rison" to -- Riso --.

Signed and Sealed this

Thirteenth Day of April, 2004

JON W. DUDAS
*Acting Director of the United States Patent and Trademark Office*